US009516981B1

(12) United States Patent
Wertz

(10) Patent No.: US 9,516,981 B1
(45) Date of Patent: Dec. 13, 2016

(54) VACUUM HOSE NOZZLE ATTACHMENT

(71) Applicant: Robert Wertz, Salt Lake City, UT (US)

(72) Inventor: Robert Wertz, Salt Lake City, UT (US)

( * ) Notice: Subject to any disclaimer, the term of this patent is extended or adjusted under 35 U.S.C. 154(b) by 600 days.

(21) Appl. No.: 13/986,849

(22) Filed: Jun. 12, 2013

(51) Int. Cl.
*A47L 9/02* (2006.01)
*A47L 9/06* (2006.01)

(52) U.S. Cl.
CPC ..... *A47L 9/0626* (2013.01); *A47L 9/02* (2013.01)

(58) Field of Classification Search
CPC ..... A47L 9/02; A47L 9/0626
USPC ..... 15/415.1
IPC ..... A47L 9/02
See application file for complete search history.

(56) References Cited

U.S. PATENT DOCUMENTS 2,659,616 A * 11/1953 Doyle, Sr. ..... A47L 9/02 15/410
4,989,294 A * 2/1991 Fischer ..... A47L 9/02 15/393
6,421,875 B1 * 7/2002 Coombs ..... A47L 9/02 15/415.1

* cited by examiner

*Primary Examiner* — David Redding

(57) ABSTRACT

A vacuum cleaner hose nozzle attachment formed from two separately molded body sections. The first body section includes spaced and parallel faces, generally triangular, front and rear walls interconnected by a top wall that curves over the apexes of the first and second walls and that connects ends of the front and rear walls. An attachment opening through the rear wall has an inlet to the second body section secured and sealed thereto. The inlet to the second body section comprises a peripheral edge forming a wide-mouthed opening fitted into and sealed to the attachment opening. A funnel wall extends rearward from the top center of the peripheral edge and normal to the rear wall and has a top center straight ridge continuing from the peripheral edge to a top center ridge of a tubular discharge end.

2 Claims, 7 Drawing Sheets

VACUUM HOSE NOZZLE ATTACHMENT

CROSS REFERENCE TO RELATED APPLICATION

Not applicable.

STATEMENT REGARDING FEDERALLY SPONSORED RESEARCH AND DEVELOPMENT

Not applicable.

REFERENCE TO MICROFICHE APPENDIX

Not applicable.

BACKGROUND OF THE INVENTION

Field of the Invention

This invention is related to nozzle attachments that are commonly attached to vacuum cleaners having a body with a motor and fan arrangement and an inlet port. Operation of the motor and fan provides suction at the inlet port to draw air, together with dirt, water, and the like, from a floor or floor covering, through the nozzle attachment. The air, dirt, water, and the like, passes through a discharge port of the nozzle attachment unit to a collection unit, such as a bag, or other receptacle, of the vacuum cleaner.

The nozzle attachment unit of the invention is particularly adapted to be attached to a hose or tube of a canister of a vacuum that is pulled on the floor by the hose and an attached tube during vacuuming. More particularly, the nozzle unit of the invention is useful where there is a need for the full nozzle to pass beneath objects such as furniture items having bottom surfaces that are raised above floor level just slightly more than the outside diameter of the vacuum hose or tube. Even less clearance is required for ends of the nozzle attachment unit to reach under objects. The nozzle of the invention is also desirable for use on inlet hoses or tubes of back pack vacuums.

At least many low profile nozzles heretofore commonly used with vacuum cleaners to clean beneath furniture and the like have restrictions and or abrupt turns in the flow passages thereof and are subject to clogging and loss of suction. Other nozzles, such as wand types, having a flat profile and an opening only in an end, may not have restrictions in the nozzles to limit air flow. However, the limited size of the inlet openings restricts flow into the vacuum so that maximum efficiency of the vacuum cleaner may not be obtained during use.

The nozzle of the present invention has a low overall profile, with downwardly tapered sides to allow it to be easily pushed, fully, or partially, under objects and to be maneuvered beneath such objects while still maintaining maximum smooth funneled flow through and into the nozzle and into an attached hose and/or tube that is connected to a vacuum cleaner.

SUMMARY OF THE INVENTION

Objects of the Invention

It is a principal object of the invention to provide a nozzle attachment to a tube or hose of a vacuum cleaner that will not clog during use in cleaning of floors or flow coverings, due to restrictions or abrupt angular changes in the flow path through the nozzle.

Other objects are to provide an effective vacuum nozzle that is easily manipulated by a user of an attached vacuum cleaner, beneath objects having a minimum clearance between the floor or floor covering and the bottom of the objects.

Features of the Invention

Principle features of the vacuum hose nozzle attachment of the invention include a two-section, injection-molded plastic body. A first body section is formed to have an elongate bottom entry opening through which air and entrained dirt, water, and the like is sucked into the nozzle attachment. The first body section has parallel front and rear walls, each having a generally triangular configuration above and at opposite elongate sides of the bottom entry opening.

The front and rear walls of the first body section are joined at their ends and upper edges by a top surface having an interior forming a smoothly curved connection between the ends and the upper edges. The top surface connecting the front and rear walls is curved at the apexes of the generally triangular front and rear walls to form a smoothly curved peak of the first body section. The rear wall of the first body section has a wide mouth discharge opening formed there through to provide for attachment of the second body section. The discharge opening has a straight bottom edge extending parallel to a central portion, i.e. about one third, or more, of the bottom edge of the rear wall of the first body section; and end edges curving upwardly from the ends of the bottom edge to the top surface and following the top surface, to beneath the apex of the rear wall.

The second body section is molded to have a rearward extending funnel wall with a wide mouth shaped inlet that fits snugly into and is secured and sealed to the discharge opening of the rear wall of the first body section, The wide mouth shaped inlet serves to receive air and entrained dirt, water and the like, that enters the first body section through the bottom inlet. The funnel wall has a straight top ridge extending rearward from the apex of the opening through the first body section and normal to the rear wall of the first body section. The top ridge continues straight along the top of a cylindrical vacuum cleaner nozzle connector. The cylindrical vacuum cleaner nozzle connector also has a bottommost surface forming a continuing straight line with the bottommost surface of the funnel inlet wall and continuing straight to the center of the bottom edge of the discharge opening of the first body section. The funnel wall includes a rearward extending top portion, including the ridge; a similar rearward extending bottom portion, including the straight line portion; and side wall portions that are angled rearward from the ends of the discharge opening of the first body section into engagement with the periphery of the inlet of the cylindrical vacuum cleaner hose connector.

LISTING OF NUMBERS OF DRAWING COMPONENTS

Numbers Components

20 vacuum cleaner nozzle attachment.
22 first body section of nozzle attachment 20.
24 second body section of nozzle attachment 20.
26 front wall of body section 22.
28 rear wall of body section 22.

30 top surface interconnecting upper edges of front and rear walls 26 and 38.
32 one end wall of body section 22.
34 central high points of each of walls 26 and 28.
36 other end wall of body section 22.
38 bottom edge of front wall 26.
40 bottom edge of rear wall 28.
42 edge of end wall 32.
44 edge of end waft 36.
46 periphery of nozzle inlet opening of nozzle attachment 20.
48 notches in periphery 46.
50 attachment opening through rear wall 28.
52 upper central edge beneath high point 34 of top surface 30.
54 bottom edge of opening 50.
56 one end of bottom edge 64.
58 other end of bottom edge 54.
60 upwardly angled edge connected to one end of bottom edge 54.
62 upwardly angled edge connected to the opposite end of bottom edge 54.
64 funnel inlet opening.
66 peripheral edge of inlet opening 64.
68 lip around peripheral edge 66.
70 tubular fitting part of second body section 24.
72 rear wall of second body section 24.
74 top center, straight, linear ridge of rear wall 72.
76 connection at top of peripheral edge 66.
78 inlet of tubular fitting 70.
80 bottom center of rear wall 74.
82 bottom linear center line of tubular fitting
84 center bottom of tubular fitting 70.
86 one end of second body section 24
88 other end of second body section 24.
90 top surface of second body section 24.

BRIEF DESCRIPTION OF THE DRAWINGS

So that the manner in which the above recited features of the present disclosure can be understood in detail, a more particular description of the disclosure, briefly summarized above, may be had by reference to the embodiment illustrated in the appended drawings. It is to be noted, however that the appended drawings illustrate only a typical embodiment of this disclosure and are therefore not to be considered limiting of its scope, for the disclosure may admit to other equally effective embodiments.

DETAILED DESCRIPTION

Figure 1:
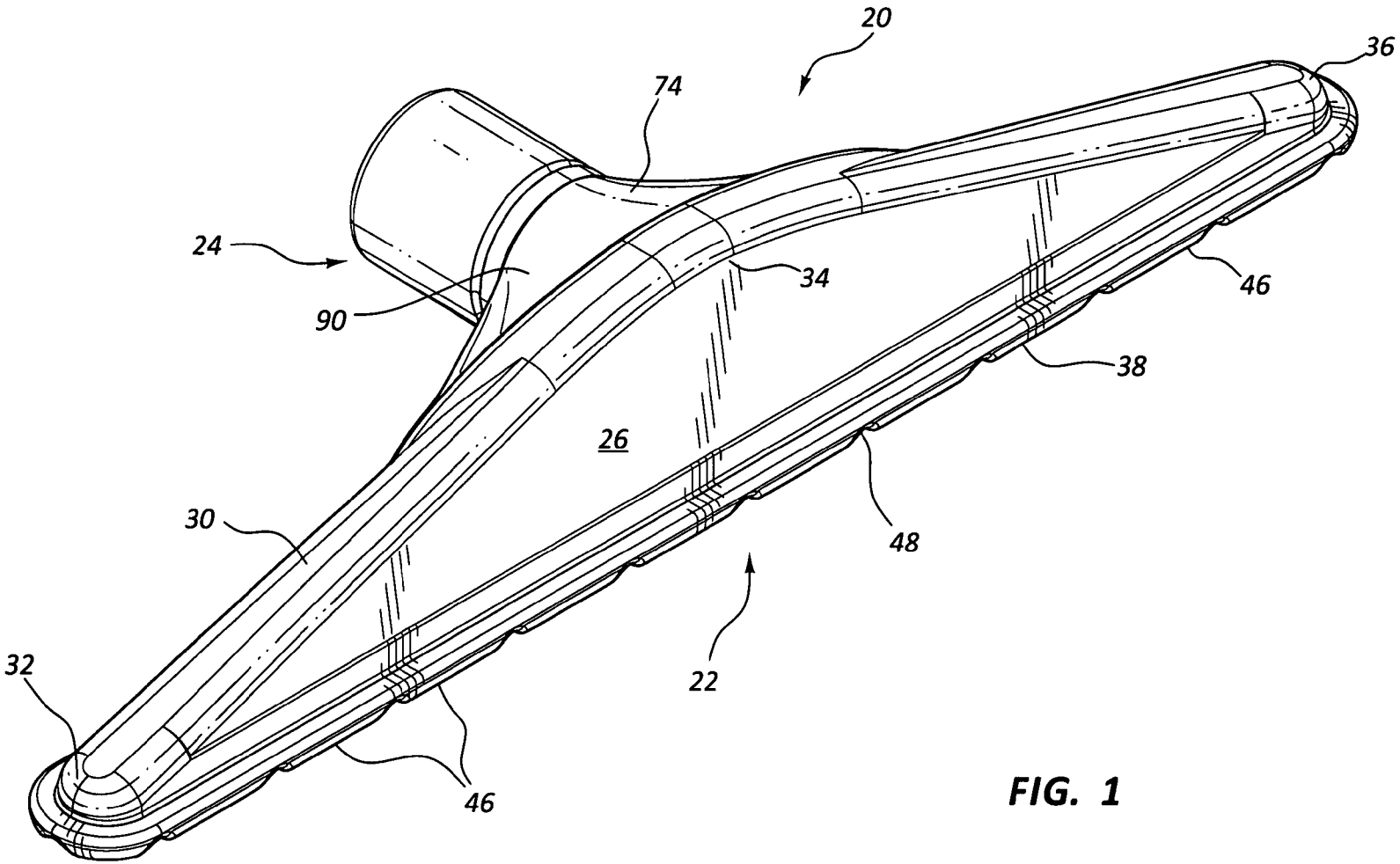
FIG. 1 is a front perspective view illustrating an example vacuum cleaner hose nozzle attachment in accordance with a certain embodiment of the present disclosure.
Figure 2:
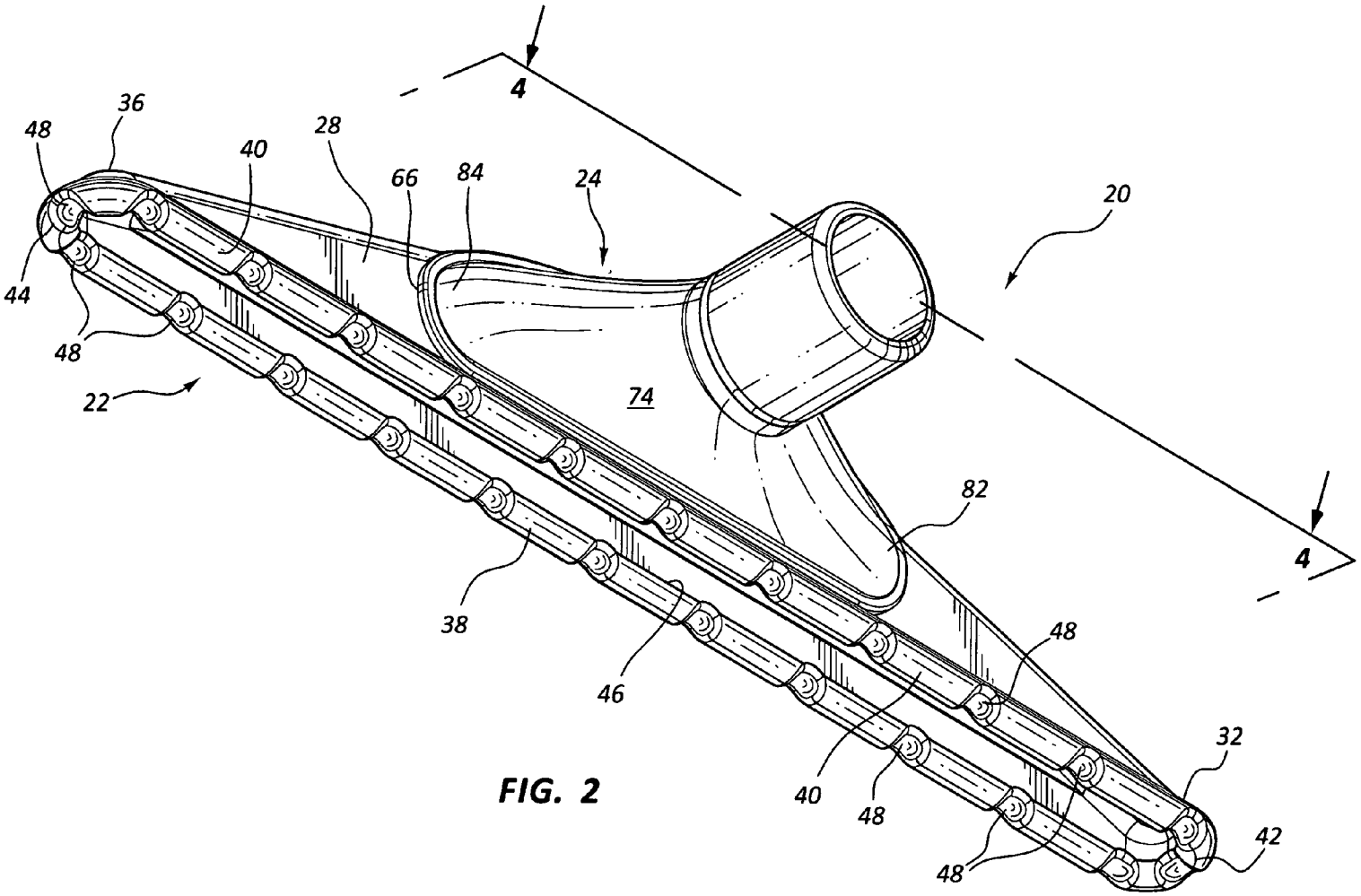
FIG. 2 is a bottom perspective view of the example vacuum cleaner hose nozzle attachment.
Figure 3:
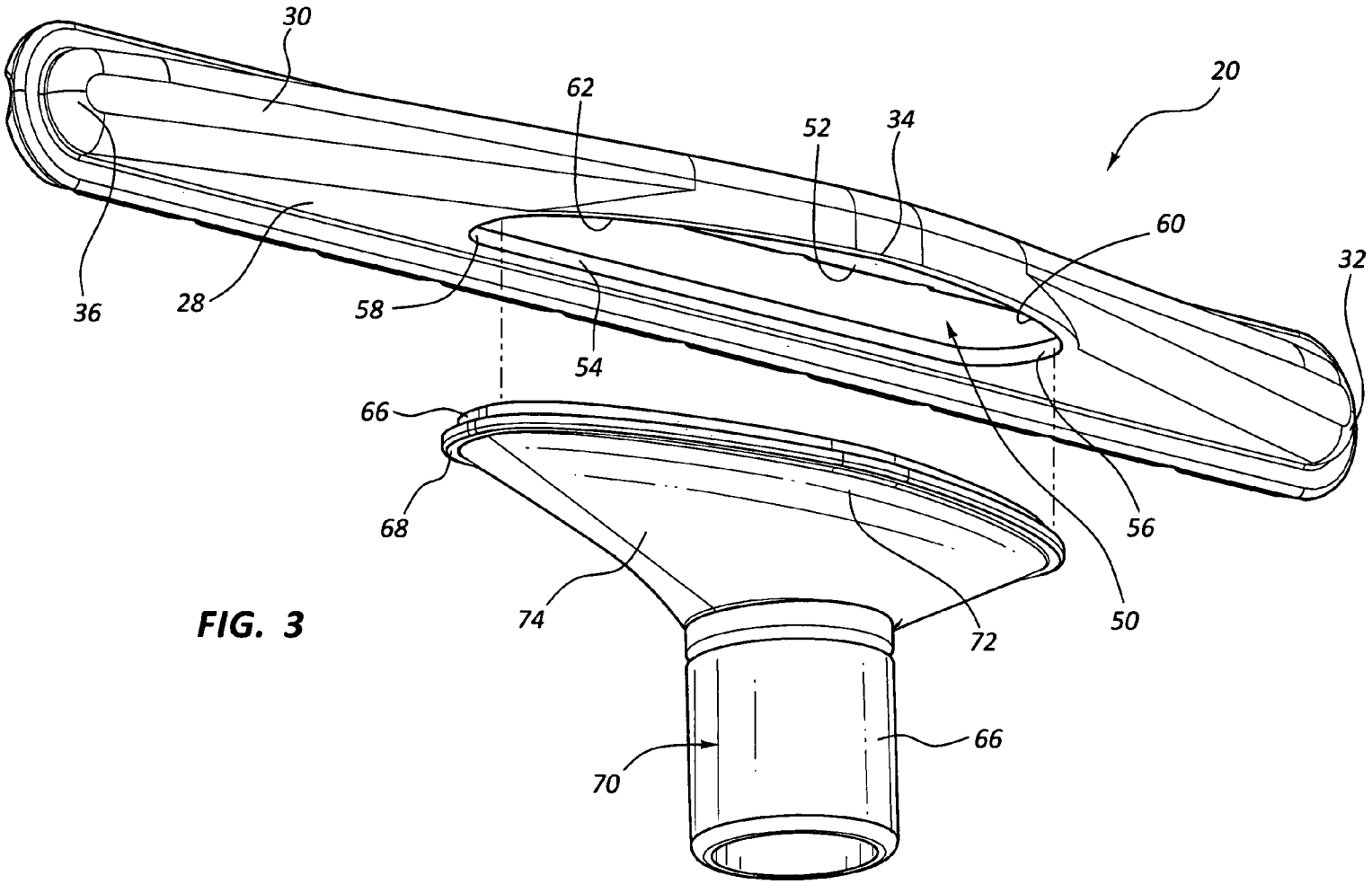
FIG. 3 is an exploded perspective view of the example vacuum cleaner hose nozzle attachment.
Figure 4:
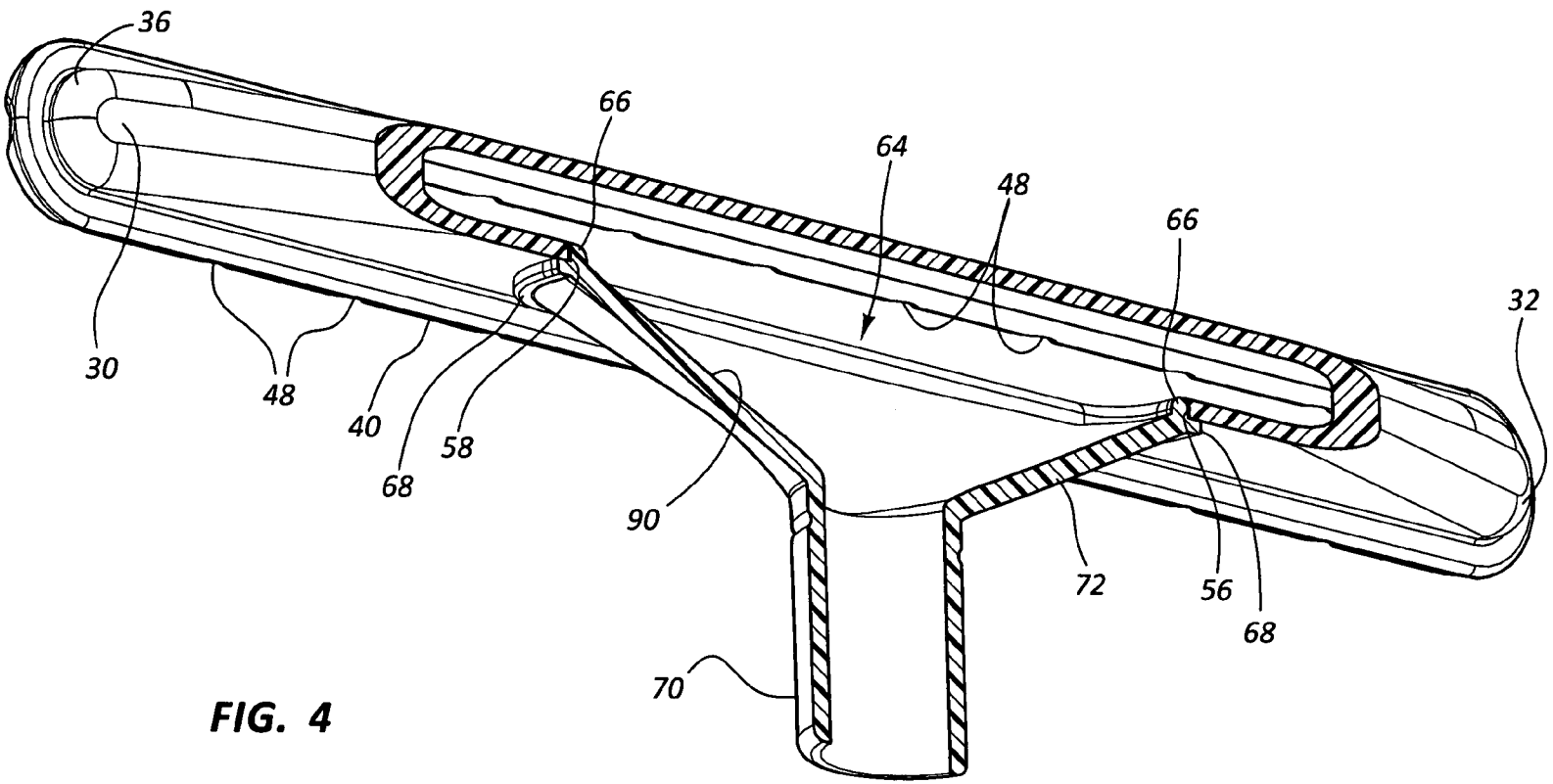
FIG. 4 is a vertical section view through the example vacuum cleaner hose nozzle attachment, taken on the line 4-4 of FIG. 2.
Figure 5:
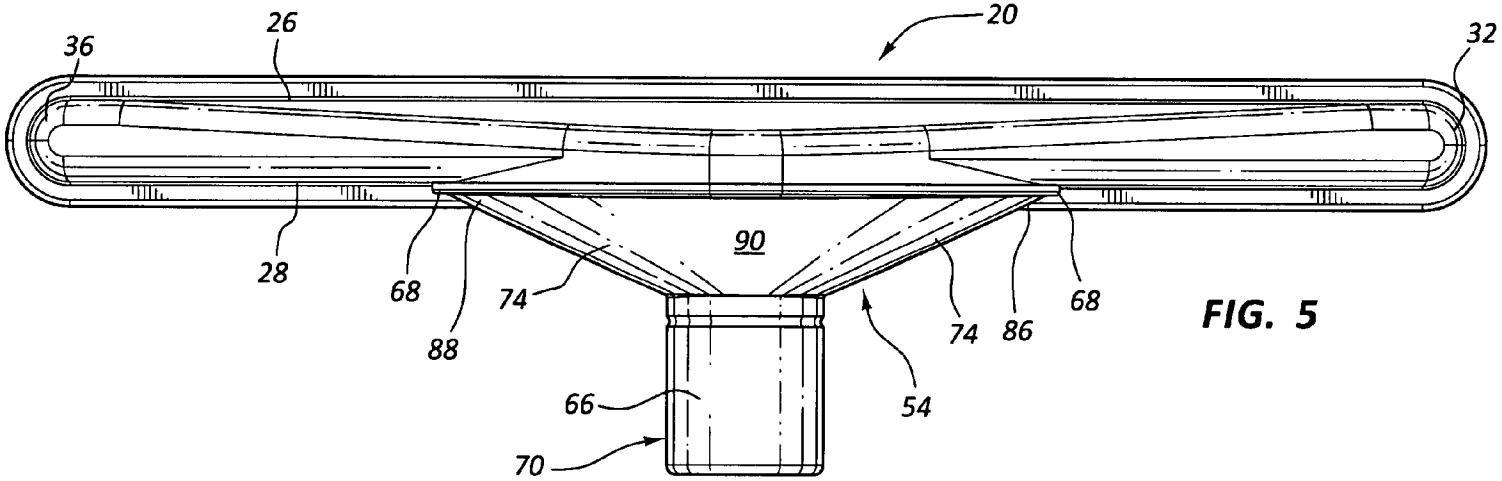
FIG. 5 is a top plan view of the example vacuum cleaner hose nozzle attachment.
Figure 6:
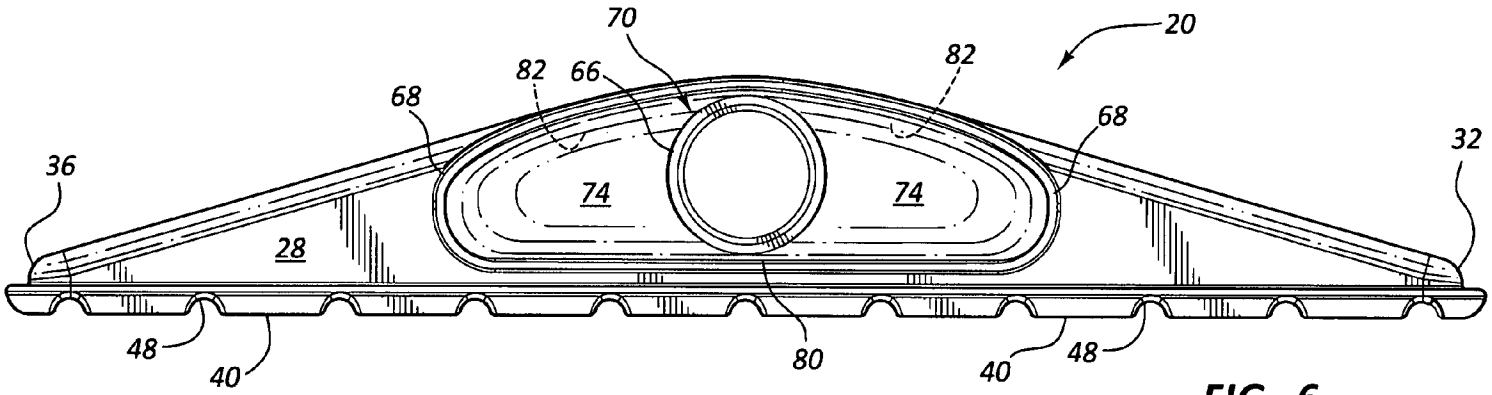
FIG. 6 is a rear elevation view of the example vacuum cleaner hose nozzle attachment.
Figure 7:
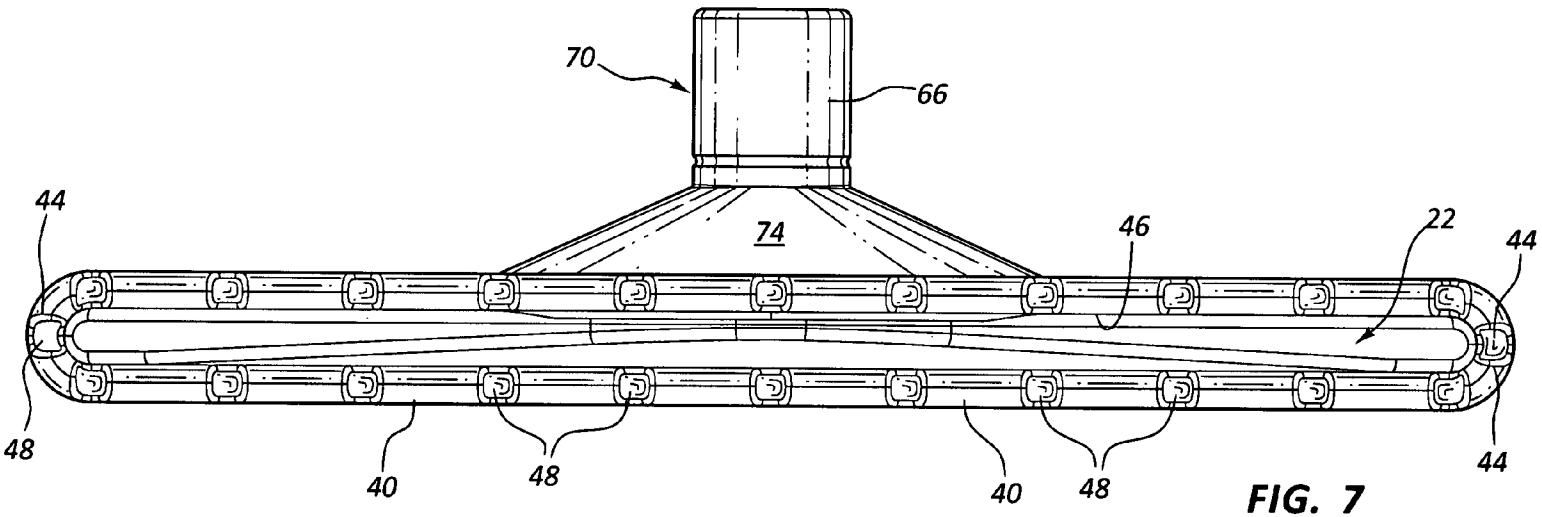
FIG. 7 is a bottom plan view of the example vacuum hose nozzle attachment.
Figure 8:
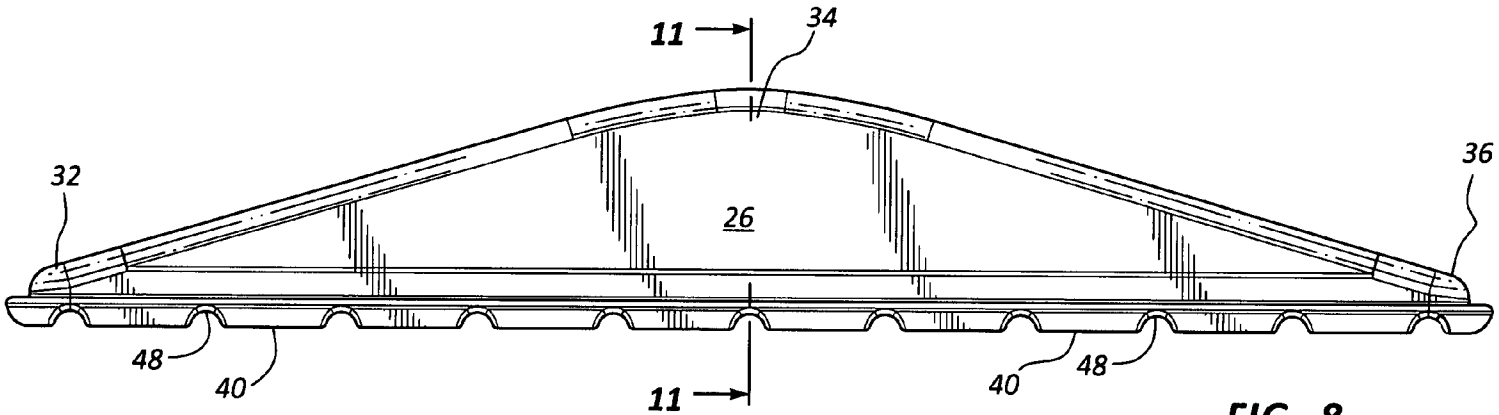
FIG. 8 is a front elevation view of the example vacuum hose nozzle attachment
Figure 9:
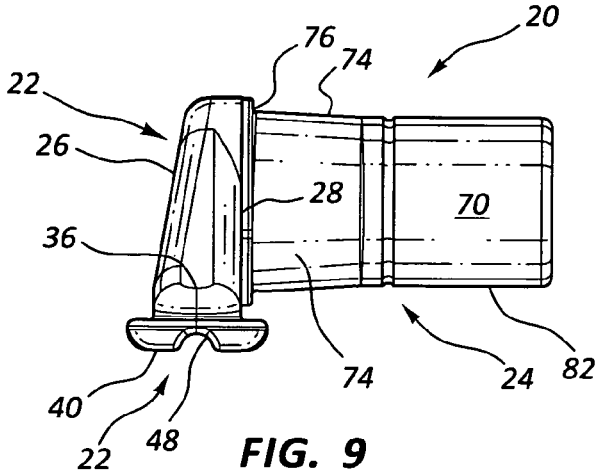
FIG. 9 is a right side elevation view of the example vacuum hose nozzle attachment.
Figure 10:
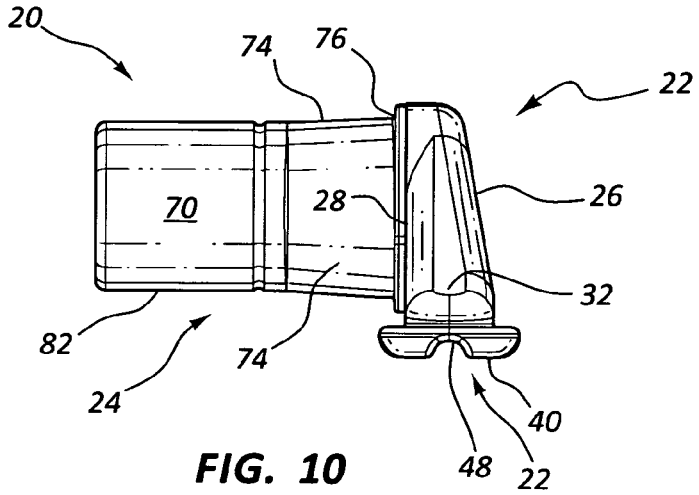
FIG. 10 is a left side elevation view of the example vacuum hose nozzle attachment.
Figure 11:
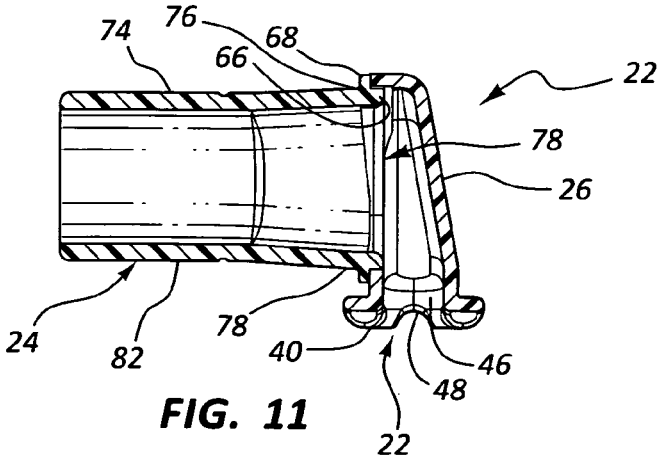
FIG. 11 is a vertical section view through the example vacuum hose nozzle attachment, taken on the line 11-11 of FIG. 8.

Referring now to the drawings:

In the illustrated preferred embodiment, the vacuum cleaner nozzle attachment 20 of the invention is formed from a first body section 22 and a second body section 24. Each of the body sections 22 and 24 is injection molded of durable plastic and they are bonded or welded together, as will be further described, to form the unitary nozzle attachment 20.

Body section 22 is molded in one piece to have spaced, parallel faced, generally triangular shaped front and rear walls 26 and 28, respectively. A top surface 30 interconnects upper edges of the front and rear walls 26 and 28 and extends from one end wall 32 of the body section 22 angularly upward, to curve over central high points 34 of the front and rear walls 26 and 28, respectively and downwardly to the other end wall 36 of the body section 22. Inner surfaces of the walls 26 and 28 and an undersurface of top surface 30 form a continuous smooth surface.

Bottom edges 38 and 40 of the front and rear walls 26 and 28, respectively, are straight, parallel and spaced apart to form, with bottom edges 42 and 44 of the end walls 32 and 36, a periphery 46 of an elongate inlet opening for the vacuum cleaner nozzle attachment 20. Periphery 46 engages the carpet or other flooring material during use of the nozzle on a vacuum hose or tube. The nozzle inlet opening periphery 46 may, if desired, have notches 48 spaced there around to insure continuous air flow through the notches and into the nozzle 20, during use by an operator (not shown).

An attachment opening 5O is formed through the rear wall 28 of the first body section 22. Opening 5O has an upper central edge 52 beneath the central high point 34 of the surface 30 of the first body section 22. A bottom edge 54 of the opening 5O is spaced above and extends parallel to the straight bottom edge 38 of the first body section 22. Outwardly curved ends 56 and 58 of bottom edge 54 have upwardly angled edges 60 and 62 that meet at the apex of the attachment opening 50.

Second body section 24 is molded to have a funnel inlet opening 64. The inlet opening 64 has a peripheral edge 66 that is shaped to conform to and fit against the inner surface of the opening 50 into the rear surface 26 of the first body section 22.

A lip 68 around the peripheral edge 66 engages the rear surface 26 of the first body section when the edge 62 and lip 68 are attached to the first piece of body section 22, by bonding, welding, or otherwise, to make a sealed connection and a unitary nozzle 20.

When the first and second body sections 22 and 24 are attached together, a tubular fitting 70 that is molded as part of the second body section 24 projects from a rear wall 72 of the second body section 24 to serve as a connector of the nozzle attachment 20 to a hose or tube of a vacuum cleaner (not shown). A top center, straight, linear ridge 74 of the rear wall 72 of the second body section 24, extends rearward from a connection 76 at the top of peripheral edge 66. The linear ridge 74 continues along the top center of funnel inlet 64 and to the center top 76 of the inlet 78 of the tubular fitting 70. Fitting 70 extends rearward from, and normal to, the face 26 of the second body section 24. Fitting 70 does not extend to a height above the top of the first body section 22. The bottom, linear center line 82 of the rear wall 74 connects smoothly to the center bottom 84 of the tubular fitting 70. Each end 86 and 88 of the second body section 24 has a top inner surface 90 extending from a top of the end to an inner side 92 of the inlet 78 of the tubular fitting 70. Each top inner surface 90 is angled and curved to smoothly interconnect the inner front and rear walls and to form the funnel inlet opening 64.

Dirt, water and the like sucked through the inlet 44 of the nozzle attachment 20 will enter the funnel inlet 64 and will be smoothly funneled into and through the tubular fitting 66 and through a hose, or tube, telescoped onto the discharge end of the tubular fitting 66 and into an attached vacuum cleaner (not shown) without encountering restrictions in the passageway.

Although a preferred embodiment of the invention has been herein disclosed it is to be understood that such disclosure is by way of example and that variations are possible without departing from the subject matter coming within the scope of the following claims, which claims define my invention.

I claim:

1. A vacuum hose nozzle attachment comprising:

a body having first and second body sections secured together to form said vacuum hose nozzle attachment; said first body section including a pair of spaced apart, parallel faced, generally triangular shaped front and rear walls;

each front and rear wall having an elongate bottom edge, an end wall having a bottom edge connecting bottom edges of each said front and rear walls at opposite ends of said walls, whereby said bottom edges of said front and rear walls and said bottom edges of said end walls form an elongate inlet opening for said vacuum hose nozzle attachment;

a top surface interconnecting said end walls and extending inwardly and upwardly to connect top edges of said front and rear walls and to curve over apexes of said front and rear walls;

an attachment opening through said rear wall, said attachment opening having an elongate bottom edge spaced above the bottom edge of said rear wall and extending intermediate the ends of said bottom edge; upwardly and inwardly turned end wall edges; and an upper edge interconnecting said end wall edges and having an apex just below the apex of the rear wall of the first body section; and said second body section including a peripheral edge forming an inlet into said second body section from inside said first body section and said peripheral edge being secured and sealed along said peripheral edge to said edge of said attachment opening through said first wall section;

said second body section further including a rear funnel wall extending rearward from said peripheral edge and having a central top linear surface extending normal too said rear wall of said first body section and continuing as a top surface of a cylindrical vacuum connector tube with an outside diameter corresponding to the distance between said apex and said bottom edge of said rear wall of said first body section, and wherein said funnel wall is smoothly slanted to direct flow into said cylindrical vacuum connector tube, whereby flow entering the vacuum hose nozzle attachment enters the elongate inlet opening, flows upwardly between the front and rear walls, is guided by said front and rear walls and said top surface through the attachment opening into the second body section and then is directed by the funnel wall into and through said cylindrical vacuum connector tube for attachment to a vacuum cleaner telescopically attached to said vacuum connector tube.

2. A vacuum hose nozzle attachment as in claim 1, wherein:

each said front and rear body section is molded from plastic and said sections are sealed together.

* * * * *